US005586962A

United States Patent [19]

Hallmark

[11] Patent Number: 5,586,962

[45] Date of Patent: Dec. 24, 1996

[54] MULTIPLE SPORT TRAINING AND EXERCISE APPARATUS

[76] Inventor: Timothy M. Hallmark, 2799 Kuykendall, Bellville, Tex. 77418

[21] Appl. No.: 378,399

[22] Filed: Jan. 26, 1995

[51] Int. Cl.[6] ..... A63B 21/02

[52] U.S. Cl. ..... 482/129; 482/123; 482/124

[58] Field of Search ..... 482/121, 122, 482/123, 124, 126, 129, 130, 138

[56] References Cited

U.S. PATENT DOCUMENTS

| | | | |
|---|---|---|---|
| D. 254,143 | 2/1980 | de Bock | 482/129 |
| 704,840 | 7/1902 | Korth et al. | 482/129 |
| 4,328,964 | 5/1982 | Walls . | |
| 4,666,151 | 5/1987 | Chillier | 482/130 |
| 4,685,670 | 8/1987 | Zinkin . | |
| 4,863,161 | 9/1989 | Telle . | |
| 4,863,163 | 9/1989 | Wehrell . | |
| 4,902,007 | 2/1990 | Ferrari | 482/138 |
| 4,961,573 | 10/1990 | Wehrell . | |
| 4,968,028 | 11/1990 | Wehrell . | |
| 5,074,551 | 12/1991 | Olschansky et al. . | |
| 5,348,524 | 9/1994 | Grant | 482/130 |

*Primary Examiner*—Lynne A. Reichard
*Attorney, Agent, or Firm*—Fish & Richardson P.C.

[57] ABSTRACT

A multiple sport training and exercise apparatus provides a constant resistive force against exercise movements. The apparatus comprises an upright frame having two upright members with a plurality of cross bar members spaced between the upright members. A base stabilizes the frame in a vertical position. One or more elastic ropes produce resistive force, with each of said elastic ropes having one end attached to the apparatus. At least one means for slidably engaging the elastic rope are positioned on at least one of the cross bar members. A means for adjusting the amount of resistive force produced by each rope enables the amount of resistance to an exercise can be quickly and easily adjusted. The apparatus can also be easily and quickly adjusted to allow an exerciser to change from exercising one set of muscles to another.

16 Claims, 6 Drawing Sheets

MULTIPLE SPORT TRAINING AND EXERCISE APPARATUS

FIELD OF THE INVENTION

The present invention relates to the field of exercise apparatuses, and particularly, to an apparatus utilizing elastic resistance against weight training and strengthening exercises, sport specific movements, and rehabilitative reconditioning of muscles.

BACKGROUND OF THE INVENTION

Various types of exercising apparatuses intended to develop and condition muscles are known in the art. Many of such apparatuses have been developed to establish optimal resistance to a force applied by the user of the apparatus throughout the entire exercise routine. Moreover, such apparatuses have attempted to eliminate the need for using a variety of different exercise equipment in performing exercises for building the strength and endurance of specific muscles and muscle groups.

Optimal physical results are known to be achieved when a relatively constant resistive force to exercise movement is maintained throughout an exercise routine. Isotonic-type exercise devices frequently rely upon free weights to provide resistance to an exerciser's movements. At some point during an exercise routine, however, the force applied due to the weights will vary as a result of the characteristic motion of a free weight during weight lifting exercises. Thus, a constant resistive force cannot be maintained.

Isokinetic exercise apparatuses, which typically employ hydraulic control systems, provide resistance proportional to the force exerted. Typically, variation of the resistance imposed on the exerciser through a particular exercise movement is permitted. For example, U.S. Pat. No. 4,863,161 Telle, Sep. 5, 1989, discloses an isokinetic apparatus which combines a weight lifting bar with a hydraulic control circuit to control the degree of resistance imposed throughout each range of movement of an exercise. The system, however, does not establish a uniform resistance at the onset or completion of a particular exercise movement. Additionally, pump powered pneumatic or hydraulic-system exercise machines do not permit the force profile to vary with individual user variations in force and range of movement.

Exercise apparatuses using elastic cords or springs to provide a desired resistive force have been developed. U.S. Pat. No. 5,074,551, Olschansky et al., Dec. 24, 1991, discloses a multiple exercise system wherein resistive force is supplied by a pair of flexible members maintained at a minimum predetermined tension by a tensioning system. The resistive force is linearly displaced using a rotatively actuated bar. The amount of tension on the system, however, can not be adjusted quickly or during an exercise routine without the exerciser having to stop exercising to make the adjustment. Moreover, each tension setting is for a set amount of resistance, therefore, the amount of tension applied cannot be adjusted in varying or very small amounts.

U.S. Pat. No. 4,961,573, Wehrell, Oct. 9, 1990, discloses a harness having elastic cords for providing resistance to boxing motions. The harness fits over the upper torso of a boxer and a system of pulleys in the harness position the elastic cords near the armpits of the boxer. Hand grips attached to the cords are used by the boxer to practice the sport specific movements of boxing, particularly, arm, hand, and reflex-type motions. The apparatus, however, will not be of much use to a person exercising for overall strengthening and conditioning.

U.S. Pat. No. 4,328,964, Walls, May 11, 1982, discloses a multiple sport exerciser having a handle attached to a plurality of elastic ropes. The handle may simulate the handle of a tennis racket, a baseball bat, golf club, or other sporting equipment. The device is anchored to a door frame, and the user positions himself as he would if playing the particular sport associated with the selected handle. The user practices his "swing" by swinging the handle forward in the manner used in the sport.

U.S. Pat. No. 4,685,670, Zinkin, Aug. 11, 1987, discloses an exercising apparatus, which may be secured to a doorway. Flexible cables threaded through multiple pulleys provide resistance to a user's movement. The pulleys allow adjusting the length of the flexible cables, thereby increasing or decreasing the resistance applied by the cables against exercise motions. Pretension is set, and must be adjusted when less or greater tension and resistance to exercise is desired. These apparatuses only provide resistance to a user's arm movements and do not allow a user to exercise other muscle groups which are frequently of equal or greater importance in successfully playing a sport.

U.S. Pat. No. 4,863,163, Wehrell, Sep. 5, 1989, and U.S. Pat. No. 4,968,028, Wehrell, Nov. 6, 1990, disclose vertical jump exercise apparatuses wherein a sophisticated tracking means directs elastic cords fastened to the waist of a user to provide a nearly constant resistive force to jumping on a base. The speed of leg motor reflexes will be increased by vertical jump conditioning, however, associated motor reflexes, such as hip rotation, can not be improved using the disclosed apparatuses. Hip rotation speed and strength have been found to be essential to achieving top athletic performance. Moreover, an exerciser can not train for a particular sport and perform a weight training program using the same apparatus. Thus, there remains a need for a multiple sport training and exercise apparatus which provides a means for a user to condition and improve the motor reflexes of all major muscles specific to a particular sport and to perform a complete weight training routine.

There is also a need for an exercise apparatus which allows a user to perform only eccentric or concentric movements over a wide range of angles. The ability to perform only eccentric or concentric movements is particularly important to successfully rehabilitating damaged or injured muscles.

SUMMARY OF THE INVENTION

The multiple sport exercise apparatuses known in the art which provide elastic resistance to movement and exercise do not allow an exerciser or athlete to condition and exercise multiple sport specific muscle groups and perform a complete weight routine on the same apparatus. The present invention provides a multiple sport training and exercise apparatus that can be used to condition, train, and exercise sport specific muscle groups critical to the performance of an athlete in a particular sport. Recreational exercisers may use the apparatus to improve particular motor reflexes in a selected sport. The apparatus can be used to perform a complete weight training or conditioning program and may be used as a part of physical therapy programs or rehabilitative exercise programs for all parts of the body. The apparatus can also be used in presurgery muscle conditioning to prepare a muscle for the trauma of surgery as well as getting it into better condition in order to shorten the recovery period.

The apparatus of the present invention is a training, exercise, and rehabilitation apparatus which provides constant resistive force against exercise movements. The amount of resistance to an exercise can be adjusted quickly and easily. The apparatus can also be easily and quickly adjusted to change from exercising one set of muscles to another. Moreover, the apparatus is lightweight and does not rely upon complicated resistive force systems to provide the desired resistive force to an exercise.

The present invention comprises a frame with two upright members having a plurality of cross bar members spaced between the upright members. A base stabilizes the frame in a vertical position. The base may be comprised of a front pair and a rear pair of legs. The pair of front legs and the pair of rear legs may be foldably connected to the frame. The base may also include a weighted base member.

One or more elastic ropes with at least one end attached to the apparatus provides a resistive force against exercise movements performed. In a preferred embodiment, up to six elastic ropes can be attached and positioned on the cross bar members. In an alternate embodiment of the apparatus, two ropes are positioned on the cross bar members. The apparatus includes at least one means for slidably engaging the elastic ropes. The preferred means for slidably engaging the elastic rope is a pulley. In alternate embodiments, an elastic rope with a suitable covering for allowing the rope to slide over the cross bar members may be used.

The apparatus additionally comprises a detachable means whereby the elastic rope can be detached from the apparatus and reattached to a different member, thereby adjusting the length of the rope and the resistive force of the elastic rope. The end of the elastic rope opposite to the end attached to the apparatus is engaged by an exerciser to perform a movement against the resistive force. Alternatively, an exerciser may perform exercises by attaching the rope at both ends and engaging the middle section of the rope. Another alternative is to have one end of the rope be engaged by an exerciser and the other end of the rope engaged by a second exerciser.

The preferred embodiment of the apparatus provides a simple manner for adjusting the amount of resistive force of the rope by increasing or decreasing the length of rope without detaching and reattaching the rope, but by using a means to draw up a length of rope and hold it securely in place, thereby decreasing the length of the rope. The amount of resistance produced by a particular elastic rope is quickly and easily increased by pulling up on the rope while it is engaged by a means for adjusting the amount of resistive force, such as a releasable clamp. To reduce the amount of resistance produced by a particular elastic rope, the clamp is released and a length of the rope is withdrawn until the desired resistive force is achieved and the clamp is reengaged on the rope. Releasable clamps are the preferred means for adjusting the amount of resistive force of the rope, however, other means for adjusting the amount of resistive force may be used and will be known to those skilled in the art. In alternate embodiments of the invention, adjusting the number of cross bar members a rope is wrapped around may be used to adjust the amount of resistive force produced by the rope.

A first support bar may be removably connected to the frame and one side of the base and a second support bar may be removably connected to the frame and the other side of the base. The base may have one or more rollers for easily moving the apparatus.

The preferred embodiment of the apparatus further comprises a front plate attached to the frame and extending between the upright members having one or more openings such that each opening allows one end of the elastic rope to pass through. The preferred embodiment further comprises a rear plate attached to the frame and extending between the upright members having one or more openings for allowing one end of the elastic rope to pass through.

The apparatus is used by an exerciser engaging the end of one or more elastic ropes and connecting the rope to a waist belt, ankle belt, handle or other device. The exerciser performs exercises and/or sport specific movements against the resistive force produced by the ropes. In the preferred embodiment, the resistive force produced by the rope can be adjusted before an exerciser begins an exercise, or during the execution of a particular exercise. The amount of resistance produced by a particular elastic rope is quickly and easily increased by pulling up on the rope while it is engaged in the clamp. The releasable clamp will maintain its grip on the rope after it is stretched the desired length. To reduce the amount of resistance produced by a particular elastic rope, the rope is released from the releasable clamp and pushed back into the clamp when the desired resistive force is achieved. For example, while an exerciser is performing an exercise, the resistive force can be adjusted in minor amounts by pulling up slightly on the rope. Greater increases in the resistive force can be accomplished by pulling up on the rope more. Because of the ease of adjusting the amount of resistive force produced by the rope, and exerciser can make the adjustments while performing the exercise. The means for adjusting the rope also allows easily lessening the amount of resistive force while performing an exercise. Thus, an exerciser can continually increase the resistive force to work harder during an exercise routine or lessen the resistive force so that the exerciser can continue to exercise even though fatiguing without stopping the exercise movement.

DETAILED DESCRIPTION OF THE INVENTION

Figure 1:
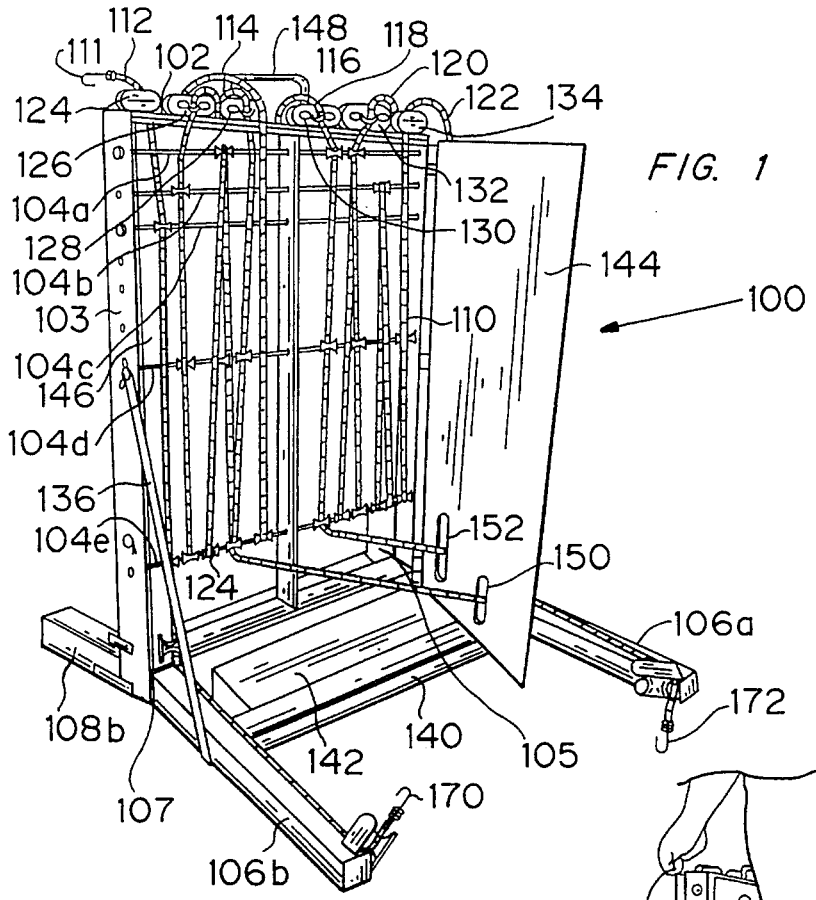
FIG. 1 is a perspective view of a preferred embodiment of the present invention.
Figure 3:
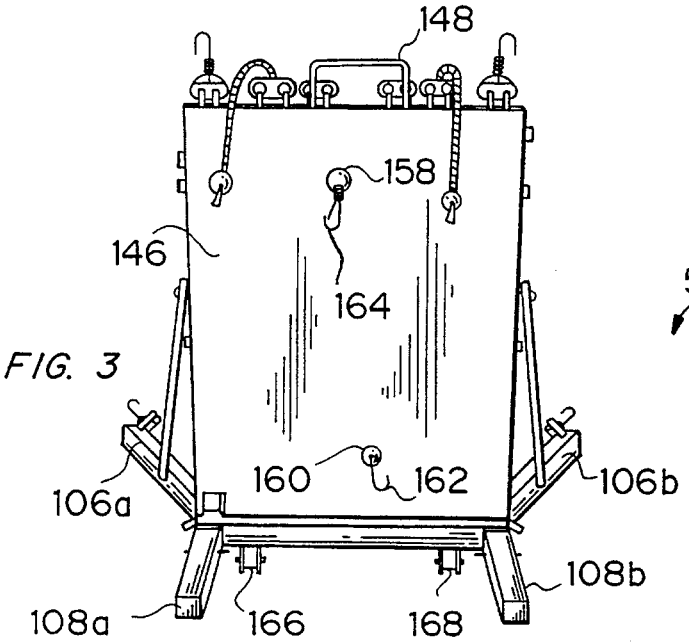
FIG. 3 is a rear perspective view of the embodiment of FIG. 1.

A preferred embodiment of the exercise apparatus 100 according to the present invention is shown generally in FIG. 1. The exercise apparatus comprises a frame 102 having two upright members 103 and 105. A plurality of cross bar members 104*a*, 104*b*, 104*c*, 104*d* and 104*e* are spaced between upright members 103 and 105. Alternate embodiments may include fewer or more cross bar members. Base 107 stabilizes the frame in a vertical position. In the preferred embodiment, the base is comprised of a pair of front legs 106*a* and 106*b*, and a pair of rear legs, rear leg 108*a*, as seen in FIG. 3, and rear leg 108*b*, seen in FIG. 1. The base also includes a weighted base member 140 having an additional weight 142 attached to it. The pair of front legs or back legs may be flared to provide increased stability to the exercise apparatus. It is preferred that the frame and base be comprised of square metal tubing, preferably steel, which is strong and relatively lightweight. In the preferred embodiment, the cross bar members are metal dowels. Suitable materials will be known to those skilled in the art.

Figure 2:
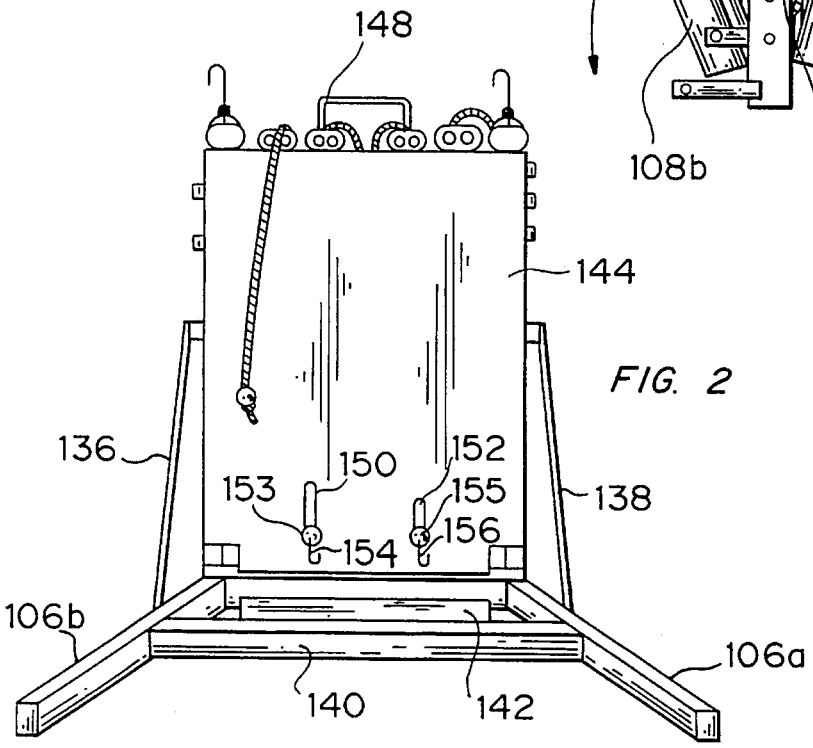
FIG. 2 is a front perspective view of the embodiment of FIG. 1.

The apparatus may also include a first support bar 136 and a second support bar 138, seen in FIG. 2, which are removably connected to upright members 103 and 105, respectively, and the sides of base 107. Support bars 136 and 138 may be connected by means known to those in the art, such as a bolt and nut. The support bars 136 and 138, weighted base member 140, and weight 142 further increase the stability of the apparatus when it is being used by an exerciser or athlete.

Figure 4:
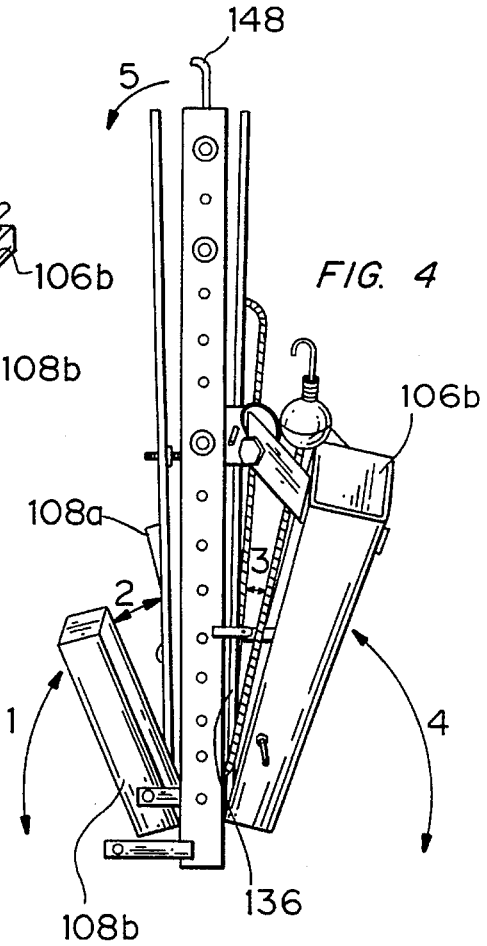
FIG. 4 is a side perspective view of the embodiment of FIG. 1.

In the preferred embodiment, the pair of front legs and the pair of rear legs are foldably connected to the frame, as shown in FIG. 4. The apparatus may be folded as indicated by arrows 1, 2, 3, and 4 for storing or transporting the apparatus. Support bars 136 and 138 may be released from the base at the front legs and rested against the frame. Front legs 106*a* and 106*b* and rear legs 108*a* and 108*b* can then be folded up against the frame. Handle 148 can be used to lean the apparatus backward, as shown by arrow 5, so that the apparatus can be rolled on rollers 166 and 168, which are seen in FIG. 3.

In the preferred embodiment of the apparatus shown in FIG. 1, elastic ropes 112, 114, 116, 118, 120, and 122 are positioned on selected cross bar members. The ropes are wrapped around the cross bar members as seen in FIG. 1. The elastic ropes may be wrapped around more or fewer bars than shown, as desired. Wrapping a rope around more bars will enable greater resistance to be produced by the rope than when it is wrapped around fewer cross bar members. Bungee ropes may be used for the elastic ropes. The elastic ropes provide resistance to the exercise and training movements of the user or users of the apparatus. The elastic ropes are slidably engaged with selected cross bar members by one or more means 124. In the embodiment shown, pulleys are used as the means to slidably engage the elastic ropes. The pulleys hold the elastic ropes in position on the selected cross bar members and allow the elastic ropes to move freely over the cross bar members. It is preferred that each rope is slidably engaged with the cross bar members. In alternate embodiments, an elastic rope with a suitable covering for allowing the rope to slide over the cross bar members may be used.

Figure 1A:
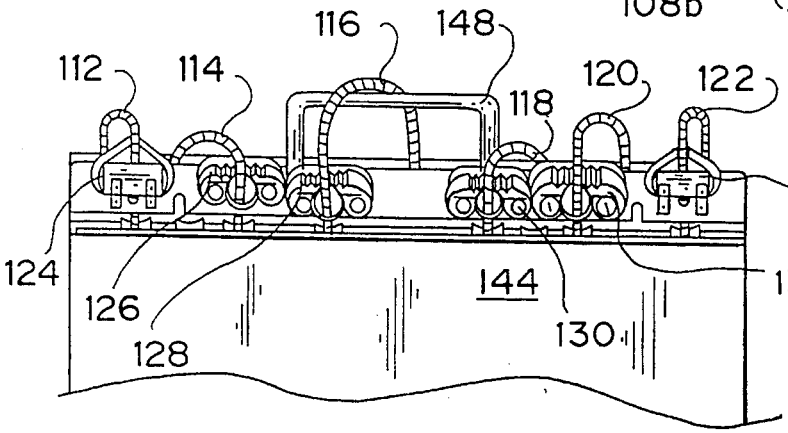
FIG. 1*a* is a detail perspective view of the embodiment of FIG. 1.

Referring to FIG. 1*a*, it is preferred that the ends of the elastic ropes are secured by means 124, 126, 128, 130, 132, and 134. Releasable clamps of the type used to restrain the lines of sail boats, in rock climbing, and the like are used to secure the ends of the elastic ropes. The releasable clamps are known as cam cleats when used with boats and as ascenders (Jumar) when used in rock climbing. The amount of resistance produced by a particular elastic rope is quickly and easily increased by pulling up on the rope while it is engaged in the clamp. The clamp will grip the rope after it is stretched. To reduce the amount of resistance produced by a particular elastic rope, the rope is released from the releasable clamp and pushed back into the clamp when the desired resistive force is achieved. Although it is preferred that clamps of the type described are used to secure the ropes to the apparatus and to adjust the amount of resistive force produced by the ropes, other means for securing the ropes to the apparatus may also be used.

Although the clamps will primarily be relied upon in the preferred embodiment to adjust the resistance of the ropes, increasing the number of cross bar members and the means for slidably engaging the elastic ropes with which a particular rope is engaged will increase the amount of total resistive force that can be produced by that rope. The ropes can be disengaged from the clamps, thereby freeing an end so that the rope can be wrapped around more or fewer of the cross bar members. Increasing the thickness of the ropes used will also increase the amount of resistance produced. Using more cross bars will allow a greater number of possible adjustments to resistive force provided by the elastic ropes.

The resistive force produced by the rope can be adjusted before an exerciser begins an exercise, or during the execution of a particular exercise. For example, while an exerciser is performing an exercise, the resistive force can be adjusted in minor amounts by pulling up slightly on the rope when using an adjustable clamp. Greater increases in the resistive force can be accomplished by pulling up on the rope more. Because of the ease of adjusting the amount of resistive force produced by the rope, and exerciser can make the adjustments while performing the exercise. The means for adjusting the rope also allows easily lessening the amount of resistive force while performing an exercise. Thus, an exerciser can continually increase the resistive force to work harder during an exercise routine or lessen the resistive force so that the exerciser can continue to exercise even though fatiguing without stopping the exercise movement. The apparatus applies a lesser amount of stress on joints than weights and other resistive force apparatuses, thereby enabling quicker recovery time between exercise sessions.

A front plate 144 is affixed to the frame of the preferred embodiment, such that it may be opened to provide access to the elastic ropes, cross bar members and means for engaging the ropes. Front plate 144 also shields the exerciser from the ropes, which may catch loose clothing worn by the exerciser. Front plate 144 is hinged to the upright frame and may be held shut by a bolt, a latch, or other means known to those skilled in the art. As is best seen in FIG. 2, front plate 144 includes a first opening 150 and a second opening 152. The end of an elastic rope exits opening 150 and the end of another elastic rope exits opening 152.

In the preferred embodiment, the lower end of any of elastic ropes 114, 116, 118, and 120 may be selected to exit through either opening 150 or 152. Hooks 154 and 156 are attached to the end of the rope exiting through opening 150 and the end of the rope exiting through opening 152, respectively. Plastic balls 153 and 155 may be placed at the end of the ropes to hold the rope more evenly in place. The ball also makes it easier to grab and pull the end of the rope. Alternatively, the balls may be made from rubber or other materials.

A rear plate 146, shown in FIG. 3, is affixed to the rear of the frame of the preferred embodiment. Rear plate 146 may be stationary or may open away from the frame as described above for front plate 144. Rear plate 146 is attached to the frame as described for front plate 144. Referring to FIG. 3, rear plate 146 includes a first opening 158 and a second opening 160. The lower end of an elastic rope exits opening 158 and the lower end of another elastic rope exits through opening 160. In the preferred embodiment, the lower end of elastic ropes 114, 116, 118, and 120 may exit through either opening 158 or 160. A hook or a clasp may be attached to the end of the ropes. A hook 162 and a clasp 164 are shown attached to the end of the rope exiting through opening 160 and the end of the rope exiting through opening 158, respectively. The ends of the ropes exiting through openings 158 and 160 may be attached to a bar, handle or belt worn by an exerciser to perform both weight lifting and training type exercises, sport specific movements, and rehabilitative exercises.

Figure 5:
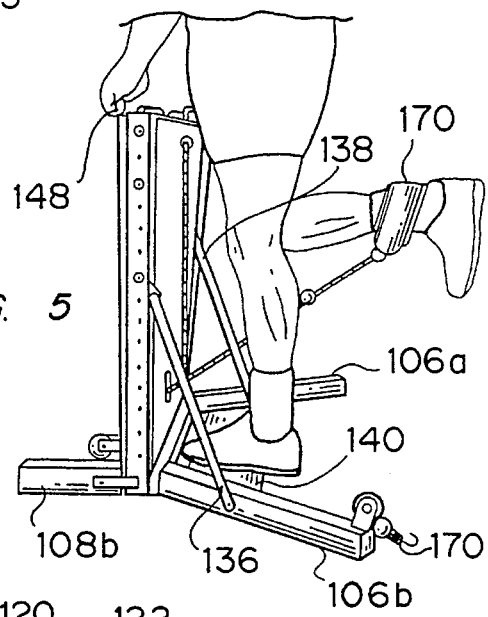
FIG. 5 is a side perspective view of the embodiment of FIG. 1 being used by an exerciser.

The ends of the ropes exiting through the openings of the front and rear plate may be attached to an exerciser, for example, as shown in FIG. 5. The ends of the ropes may be attached to an exerciser for performing strengthening and weight training-type exercises. Sport specific movements and rehabilitative exercises may also be performed using the apparatus. Examples of exercises and sport specific training movements that may be performed using the present invention will be discussed in greater detail below. The multiple ropes allow more than one exerciser to use the apparatus at the same time.

It is preferred that elastic rope 112 and elastic rope 122 are positioned on selected cross bar members such that one end of the ropes travel along front leg 106*b* and 106*a*, respectively. A hook 170 is connected to elastic rope 112 and a hook 172 is connected to elastic rope 122. Hooks 170 and 172 can be connected to a waist belt on an exerciser so that the exerciser can jump against the resistance produced by elastic ropes 112 and 122. An exerciser or athlete may practice jumping against the resistive force of the elastic ropes to improve jump motor reflexes and strengthen leg and other muscles.

The ends of the ropes may also be attached to a bar or handle for performing weight training or conditioning exercises, or to an ankle belt worn by the exerciser to perform a variety of leg strengthening and conditioning exercises and movements. Sport specific movements can also be practiced and developed using the apparatus. For example, an athlete could attach elastic rope 112 or 122 to an ankle belt to practice the kicking motion for kicking a football, or actually kick a football against the resistance applied by the rope.

An athlete may attach one or more of the ropes to a waist belt worn in order to practice swinging a baseball bat. Particularly, the ends of ropes 112 and 122 having hooks 170 and 172, as shown in FIG. 1, can be attached to an athlete to practice baseball, and other sport specific movements. Because the athlete's positioning and movements are not restricted in any way by the structure of the apparatus, batting can be practiced using a full swing while maintaining the desired feet and body positioning. The resistive force applied by the elastic rope conditions and strengthens the athlete, such that when the resistive force is removed, the batter will have a faster and smoother hip rotation, and improved foot placement and swing follow through. The constant resistive force applied to the hip rotation will make the batter work harder to complete his swing, thus, when the resistive force is no longer applied, an increase in the speed of hip rotation and strength should be recognized. Practicing batting against the resistive force produced by the ropes will improve the batters strength and speed of hip rotation, thereby improving hitting ability.

The ropes can also be attached to a waist belt worn by a golfer to practice his golf swing against the resistance of the elastic ropes. The ends of one or more of the ropes can be attached to wrist belts worn by a boxer when practicing punching motion or when throwing a medicine ball to improve arm strength and reflexes. A baseball catcher can attach one or more of the ropes to a waist belt to improve his ability to come out of his stand. A baseball player can attach one or more of the ropes to wrist belts to practice throwing a ball against the applied resistance. Sprinters can attach the ropes to a waist belt to practice sprint starts. Swimmers may develop arm muscles and stroke movements using the apparatus. The apparatus can be used to practice sport specific movements for a wide variety of sports in addition to those given as examples herein.

An example of a strengthening and conditioning exercise that may be performed using the apparatus is shown in FIG. 5. In FIG. 5, the end of an elastic rope is attached to an ankle belt 170. The exerciser is shown performing leg curls by lifting the lower part of his leg against the resistance produced by the elastic rope. A variety of other exercises may be done using the ends of the ropes exiting through the front plate. For example, in addition to the leg curls shown, biceps curls, triceps extensions, shoulder press, lateral shoulder raise, front shoulder raise, rear shoulder raise, back pullover, seated back row, reverse curls, wrist curls, neck curls, peck flies, chest crosses, leg extensions, leg curls, kick backs, upright rows, leg abductions, leg adduction, anterior tibialis pulls, single arm pulls, and other exercises may be performed using the apparatus. The ends of the ropes may also both be attached to a waist belt, thus enabling an exerciser to perform squats. The exercises that may be performed are the same as those that are generally performed using weights.

An exerciser can use the end of elastic rope 112, 114, 116, 118, 120, or 122 to perform exercises. A handle or a bar similar to the type attached to weight machines may be attached to the end of a rope for performing arm curls, triceps extensions, and any other weight training-type exercise that may performed using a bar or handle. The ropes can also be used to practice rows and leg exercises. Handle 148 can be used, as shown in FIG. 5, by an exerciser to balance himself while exercising.

The constant resistive force produced by the elastic ropes of the apparatus and the ease with which that force can be adjusted makes the present invention ideally suited to use in rehabilitative programs. A person overcoming injuries or disabling illness can begin minimal exercise efforts and work up to greater exercise efforts using the apparatus. The means for adjusting the resistive force produced by the ropes allows a person to begin an exercise movement against no resistance and as the person reaches a point in the exercise, slight or greater resistive force can immediately be applied by engaging the elastic rope in the clamp. The resistive force being applied can also be released immediately if necessary during an exercise. The ability to do so is desirable when exercising and rehabilitating or retraining injured, damaged, or atrophied muscles.

Figure 6:
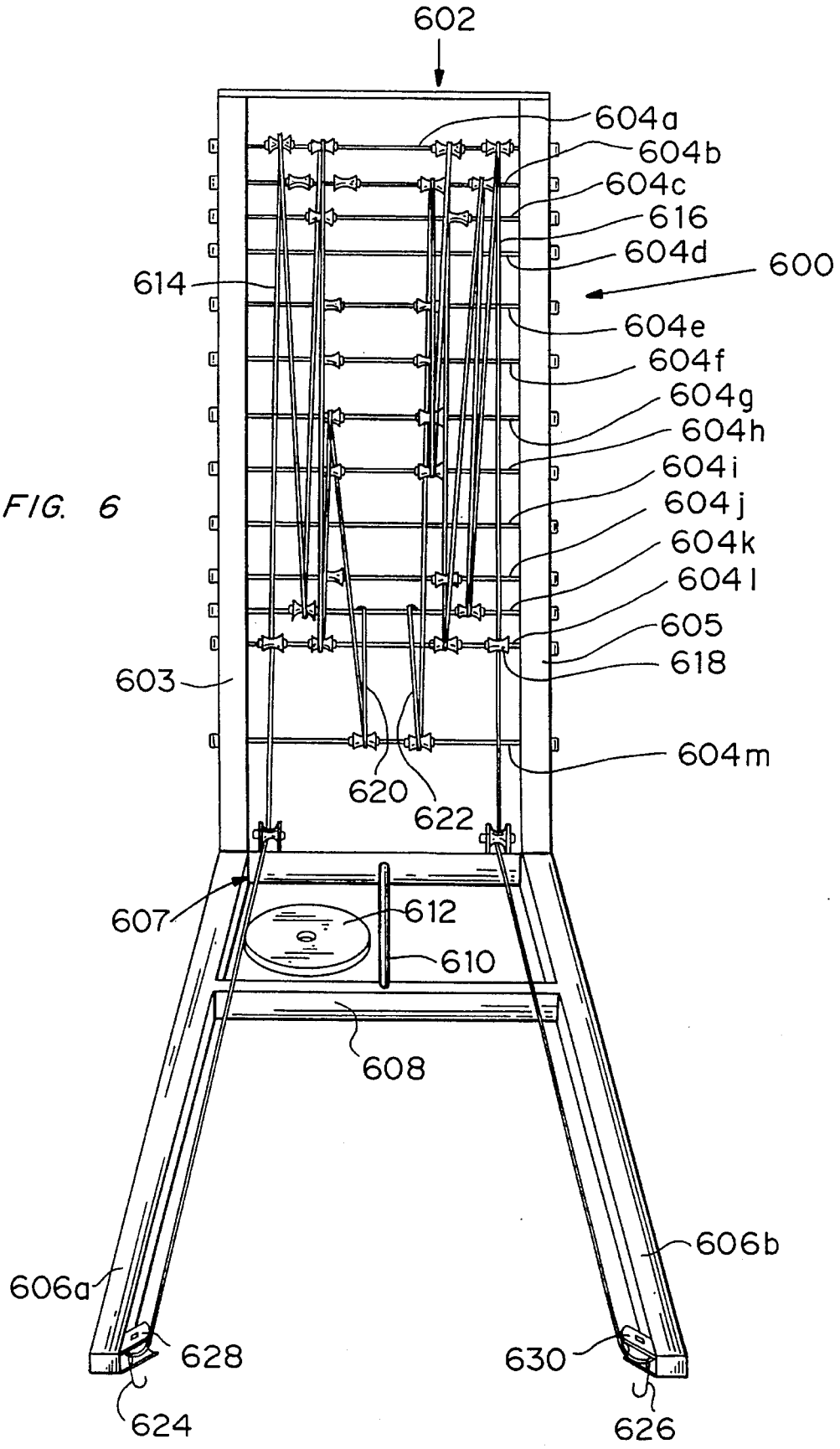
FIG. 6 is a front perspective view of an alternate embodiment of the present invention.

An alternate embodiment of the present exercise apparatus is shown generally as 600 in FIG. 6. An alternate embodiment of the exercise apparatus comprises a frame 602 having two upright members 603 and 605. A plurality of cross bar members 604*a*, 604*b*, 604*c*, 604*d*, 604*e*, 604*f*, 604*g*, 604*h*, 604*i*, 604*j*, 604*k*, 604*l*, and 604*m* are spaced between upright members 603 and 605. A base 607 stabilizes the frame in a vertical position. The base may be comprised of a pair of legs 606*a* and 606*b*. The base also includes a weighted base member 608 having a post 610 attached to it for accommodating a weight 612. The pair of legs may be flared to provide increased stability to the exercise apparatus. Weighted base member 608 adds additional stability to the apparatus when it is being used by an exerciser.

Elastic ropes 614 and 616 are positioned on selected cross bar members. The elastic ropes provide resistance to the exercise and training movements of the user of the apparatus, as described above. The elastic ropes are slidably engaged with selected cross bar members by one or more means 618. Pulleys or other means known to those skilled in the art may be used to slidably engage the elastic ropes. The pulleys hold the elastic ropes in position on the selected cross bar members and allow the elastic ropes to move freely over the cross bar members with which the elastic ropes are engaged. The amount of resistance can be increased by adjusting the number of cross bar members with which the rope is engaged.

The elastic ropes may be detachably secured to the base or a cross bar member by a hook attached to each end of the ropes. In alternate embodiments, clips may be attached to the ends of the elastic ropes for attaching to the base or cross bar members. In the embodiment shown, a long hook 620 is attached to the end of elastic rope 614 and a long hook 622 is attached to the end of elastic rope 616 for securing the ropes to a selected cross bar member. Elastic ropes 614 and 616 are also securable to the apparatus at the base to legs 606*a* and 606*b*, respectively. Elastic ropes 614 and 616 are positioned such that they travel the length of legs 606*a* and 606*b*, respectively. A hook 624 is attached to the end of rope 614 opposite to long hook 620 and hook 626 is attached to the end of rope 616 opposite to long hook 622. Hook 624 and hook 626 are attached to legs 606*a* and 606*b*, respectively, thereby securing the ropes to the apparatus. The ropes may be detached from the apparatus at either the cross bar members or the legs and attached to an exerciser or a handle or other device used by the exerciser to perform exercises or sport specific movements against the resistive force of the ropes.

Figure 7:
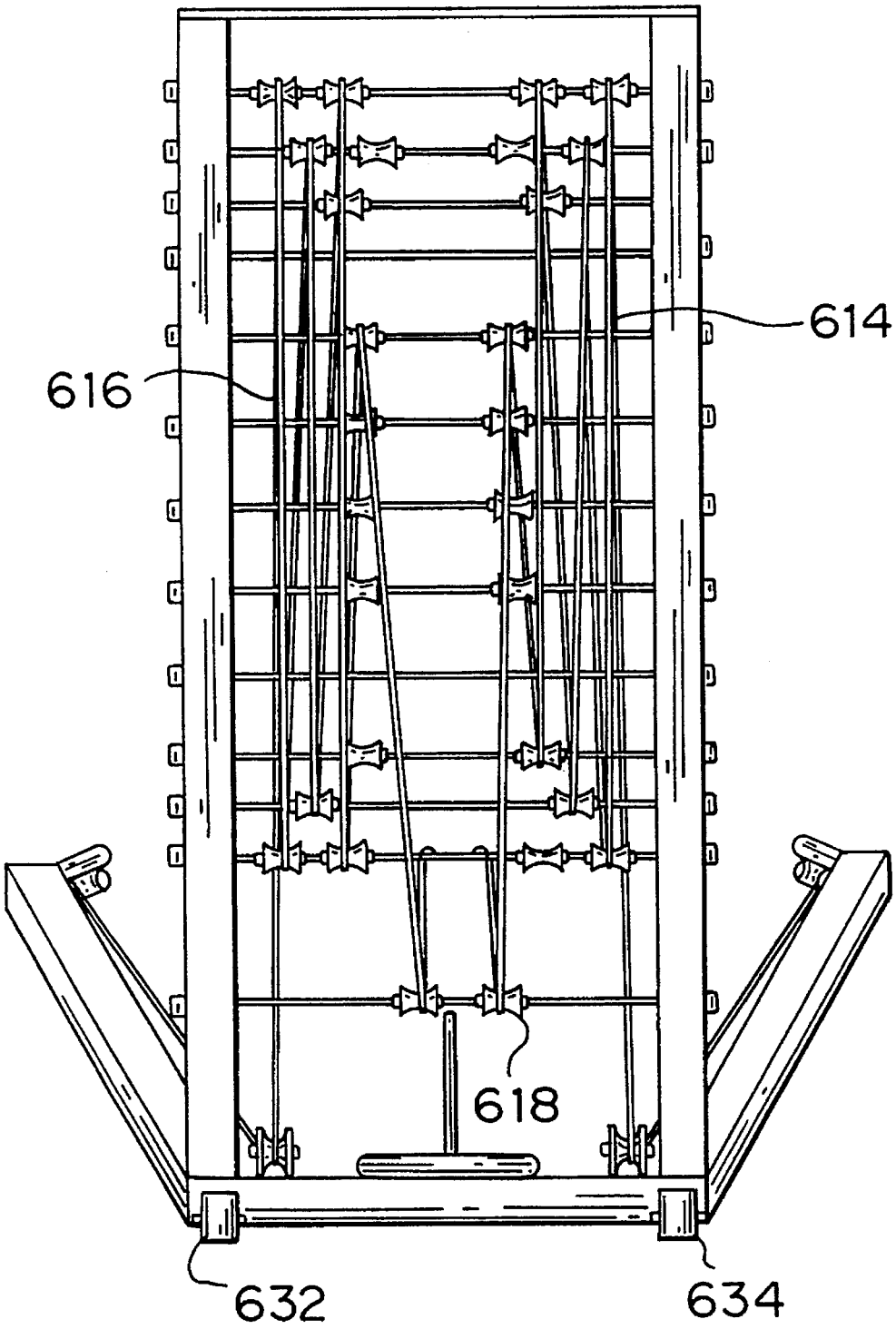
FIG. 7 is a rear perspective view of an alternate embodiment of the present invention.

Referring to FIG. 7, a selected configuration for positioning elastic cords 614 and 616 through a selected number of pulleys 618 is shown as it would appear from the rear of the apparatus. In the embodiment shown, rollers 632 and 634 are affixed to the base so that the apparatus may easily be moved by tipping it backward and rolling it on the rollers.

Figure 8:
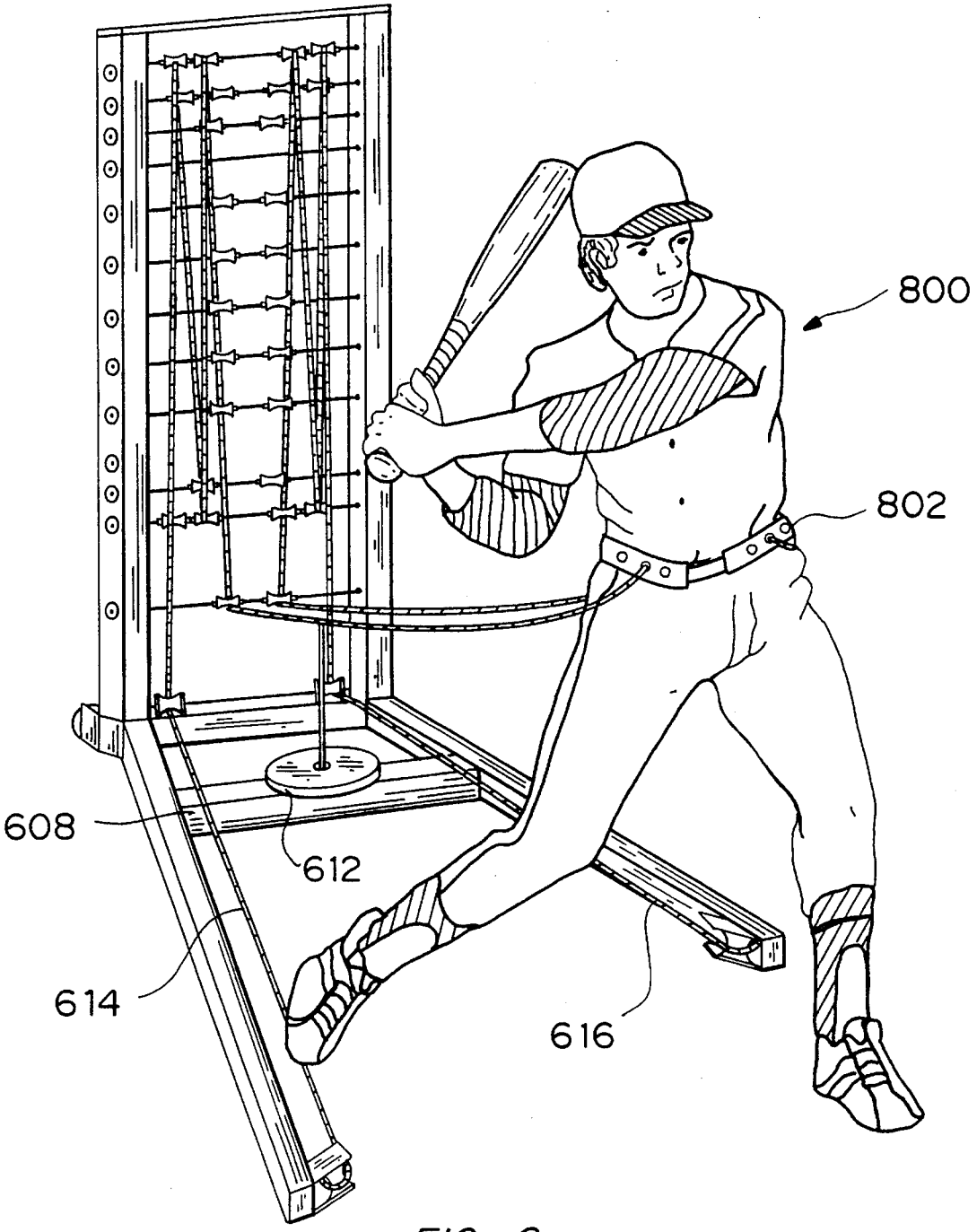
FIG. 8 is a perspective view of an alternate embodiment of the present invention being used by an athlete.

FIG. 8 shows an alternate embodiment of the invention being used by a baseball player 800 to improve the speed and strength of his hip rotation. The ends of elastic ropes 614 and 616 are attached to belt 802 worn by the athlete. The athlete practices his swing against the resistive force of the elastic rope. Weight 612 is shown positioned on base member 608 to increase the stability of the apparatus when used to perform sport specific movements.

Figure 9:
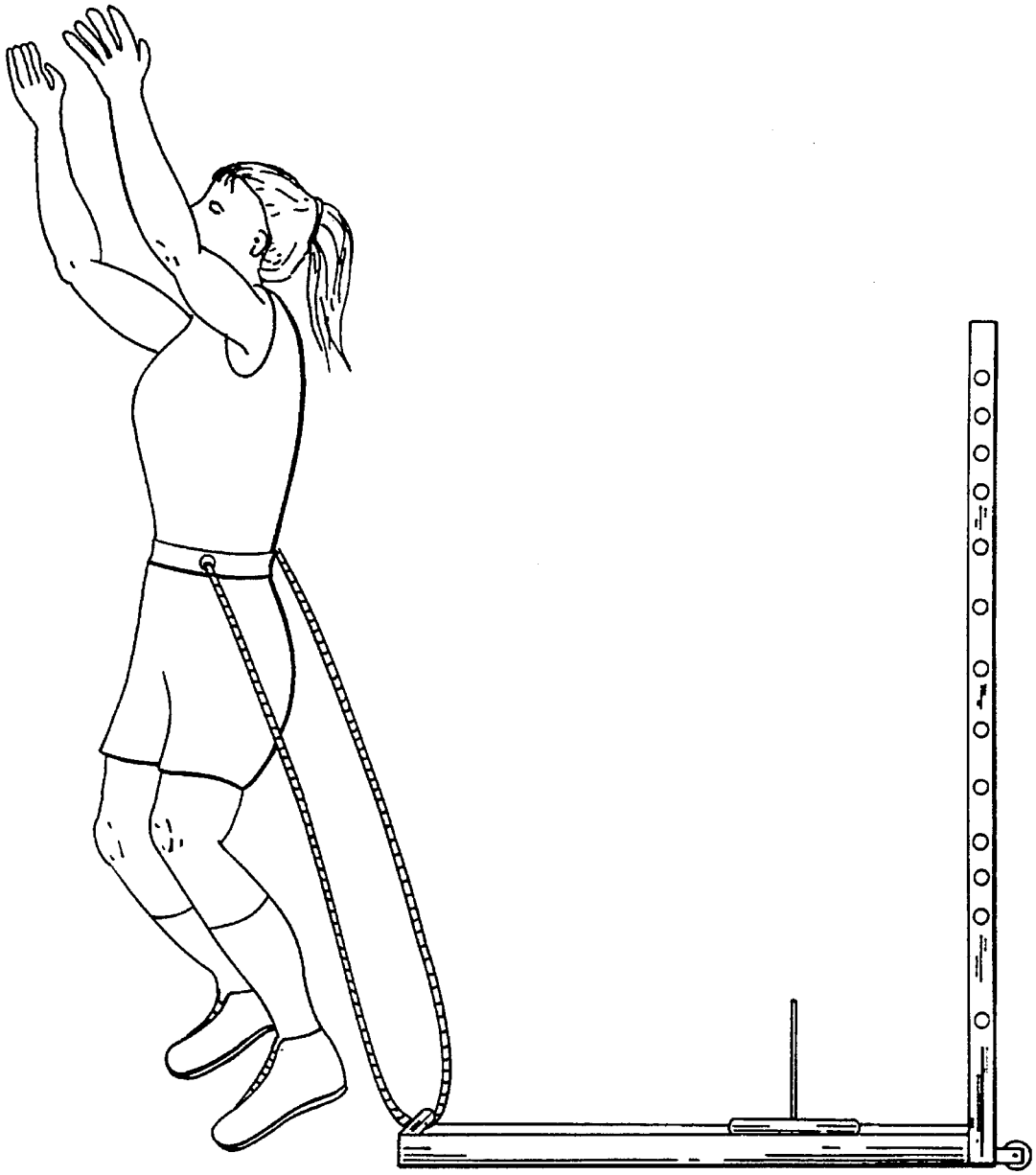
FIG. 9 is a side plan view of an alternate embodiment of the present invention being used by an athlete.

As with the preferred embodiment, the more cross bar members an elastic rope is wrapped around, the greater will be the amount of resistive force provided by the elastic rope. It is generally desirable for both elastic ropes to be wrapped around the same cross bar members and pulleys and in the same configuration when a user of the apparatus will be training and/or exercising against the resistive force of both ropes at the same time, such as when jumping as shown in FIG. 9. The elastic ropes can be attached a waist belt worn by an exerciser so that the exerciser can jump against the resistance produced by the elastic ropes as described above. The ends of the ropes may also be attached to a bar or handle for performing weight training or conditioning exercises, or to an ankle belt worn by the exerciser to perform a variety of leg strengthening and conditioning exercise and sport specific movements of the type discussed above.

As many possible embodiments may be made of the invention without departing from the scope thereof, it is to be understood that all matter herein set forth or shown in the accompanying drawings is to be interpreted as illustrative and not in a limiting sense.

What I claim is:

1. A multiple sport training, exercise, and rehabilitation apparatus comprising:

a frame having two upright members with a plurality of cross bar members between the upright members;

a base stabilizing the frame in a vertical position;

one or more elastic ropes as the means for producing a resistive force, each of said elastic ropes having at least one end attached to the apparatus and the other end of the rope attachable to an exerciser; and at least one clamp per each elastic rope provided on the frame for releasably engaging the elastic ropes whereby the length of the elastic rope is adjustable thereby producing resistance by the elastic ropes which may be varied according to the length of elastic rope clamped.

2. The multiple sport training, exercise, and rehabilitation apparatus of claim 1, further comprising at least one means for slidably engaging the elastic rope on at least one of the cross bar members.

3. The multiple sport training, exercise, and rehabilitation apparatus of claim 1, wherein at least one end of the elastic rope includes a means whereby the elastic rope can be detached from the apparatus and attached to an exerciser to provide resistance to a movement performed by the exerciser.

4. The multiple sport training, exercise, and rehabilitation apparatus of claim 2, wherein the means for slidably engaging the elastic rope is a pulley.

5. The multiple sport training, exercise, and rehabilitation apparatus of claim 1, wherein the base comprises a pair of front legs extending outwardly from the base and a pair of rear legs extending rearwardly from the base.

6. The multiple sport training, exercise, and rehabilitation apparatus of claim 5, wherein the base comprises a pair of front legs foldably connected to the frame, a pair of rear legs foldably connected to the frame.

7. The multiple sport training, exercise, and rehabilitation apparatus of claim 1, wherein the base includes a weighted base member.

8. The multiple sport training, exercise, and rehabilitation apparatus of claim 1, further comprising a first support bar removably connected to the frame and one side of the base and a second support bar removably connected to the frame and the other side of the base.

9. The multiple sport training, exercise, and rehabilitation apparatus of claim 1, wherein one or more roller is affixed to the base.

10. The multiple sport training, exercise, and rehabilitation apparatus of claim 1, wherein the elastic rope is a bungee rope.

11. The multiple sport training, exercise, and rehabilitation apparatus of claim 1, wherein the apparatus further comprises a front plate affixed to the frame and extending between the upright members having one or more openings such that each opening allows passage of at least one elastic rope.

12. The multiple sport training, exercise, and rehabilitation apparatus of claim 1, wherein the apparatus further comprises a rear plate affixed to the frame and extending between the upright members having one or more openings such that each opening allows passage of at least one elastic rope.

13. The multiple sport training, exercise, and rehabilitation apparatus of claim 1, wherein both ends of at least one of the elastic ropes is attached to the apparatus and whereby movement against the resistive force can be exerted between said ends of the elastic rope.

14. A multiple sport training, exercise, and rehabilitation apparatus comprising:

a frame having two upright members having a plurality of cross bar members spaced between the upright members;

a pair of front legs extending from the frame stabilizing the frame in a vertical position;

at least two elastic ropes as the means for producing resistive force each of said elastic ropes having one end attached to one of the cross bar members and the end opposite to the attached end is not attached thereby providing a free end of said elastic rope to provide resistance to a movement performed by the exerciser;

one or more means for slidably engaging each elastic rope positioned on selected cross bar members; and at least one clamp per each elastic rope provided on the frame for releasably engaging the elastic ropes whereby the length of the elastic rope is adjustable thereby producing resistance by the elastic ropes which may be varied according to the length of elastic rope clamped.

15. A multiple sport training, exercise, and rehabilitation apparatus comprising:

a frame having two upright members having a plurality of cross bar members spaced between the upright members;

a pair of front legs extending outwardly from the frame and a pair of rear legs extending rearwardly from the frame stabilizing the frame in a vertical position;

at least two elastic ropes as the means for producing resistive force;

at least one clamp per each elastic rope provided on the frame for releasably engaging the elastic ropes whereby the length of the elastic rope is adjustable thereby producing resistance by the elastic ropes which may be varied according to the length of elastic rope clamped;

an end of the each rope being engageable by an exerciser for performing a movement against the resistive force; and one or more means for slidably engaging the elastic ropes positioned on selected cross bar members.

16. A multiple sport training, exercise, and rehabilitation apparatus of claim 1 wherein the elastic rope is detachable and reattachable to the cross bar members of the apparatus thereby providing an adjustment means for the resistive force of the elastic rope in addition to the clamp.

* * * * *